US005476031A

United States Patent [19]

Rembold et al.

[11] Patent Number: 5,476,031

[45] Date of Patent: Dec. 19, 1995

[54] HYDRAULIC SETTING DEVICE

[75] Inventors: Helmut Rembold, Stuttgart; Martin Müller, Asperg, both of Germany

[73] Assignee: Robert Bosch GmbH, Stuttgart, Germany

[21] Appl. No.: 211,330

[22] PCT Filed: Sep. 4, 1992

[86] PCT No.: PCT/DE92/00747

§ 371 Date: Mar. 25, 1994

§ 102(e) Date: Mar. 25, 1994

[87] PCT Pub. No.: WO93/07362

PCT Pub. Date: Apr. 15, 1993

[30] Foreign Application Priority Data

Oct. 10, 1991 [DE] Germany ..... 37 37 696.9

[51] Int. Cl.[6] ..... F15B 13/02

[52] U.S. Cl. ..... 91/51; 91/421

[58] Field of Search ..... 91/51, 421

[56] References Cited

U.S. PATENT DOCUMENTS 2,983,278 5/1961 Heintz ..... 91/51
3,042,058 7/1962 Lucien ..... 91/51
3,047,010 7/1962 Rothfuss ..... 91/51
3,096,690 7/1963 Hayner ..... 91/51
3,270,508 9/1966 Smith et al. ..... 91/51
3,516,331 6/1970 Oelrich et al. .

FOREIGN PATENT DOCUMENTS 859350 12/1940 France ..... 91/51
3616234 11/1987 Germany .

*Primary Examiner*—F. Daniel Lopez
*Attorney, Agent, or Firm*—Michael J. Striker

[57] ABSTRACT

The hydraulic setting device (10) has a differential cylinder (11) whose pressure spaces (14, 18) can each be acted upon by a pump (17). The pressure conduits (15) and (19) between the pump and the two pressure spaces (14) and (18) are connected to a control valve (31) by means of control conduits (29) and (33). A part pressure can be set in the pressure spaces (14) and (18) by spilling pressure medium by corresponding activation of the control valve.

7 Claims, 2 Drawing Sheets

HYDRAULIC SETTING DEVICE

PRIOR ART

The invention is based on a hydraulic setting device of the generic type of the main claim. A hydraulic setting device is known, from U.S. Pat. No. 3,516,331, with a differential cylinder whose pressure space associated with the larger effective pressure surface of the differential piston is controlled by means of a 3/2-way valve. A pressure difference, which causes an adjusting motion, can be generated in the two pressure spaces by correspondingly pulsing the 3/2-way valve. Such a hydraulic setting device has the disadvantage that when the differential piston is stationary, i.e. unmoved, relatively high pressures are present in the pressure spaces, these pressures being no smaller or only slightly smaller than the adjustment pressures. Because of this, a high expenditure of energy is necessary in the hold position (stationary position) of the differential piston and this can lead to high costs in the operation of the hydraulic setting device.

A hydraulic setting device in which these disadvantages are avoided is known from German Offenlegungsschrift 40 37 824. In this known hydraulic setting device, the pressure space arranged at the large piston area of a differential cylinder is activated by means of a control valve which can be actuated electro-magnetically. This control valve is configured in such a way that it has negative overlap in its central position. It is activated in such a way that the pressures in the pressure spaces of the differential piston remain approximately constant and in such a way that, in the stationary position of the differential piston, the hold pressures are substantially smaller than the adjustment pressures. Such a hydraulic setting device is, for example, employed for actuating a device which adjusts the camshaft relative to the crankshaft in an internal combustion engine (German Offenlegungsschrift 36 16 234.) In order to seal the respective pressure-carrying connection securely against the return connection in the end positions of the control valve, guide gaps— in some cases narrow and long—are necessary for the valve element in these control valves. Because of this, these control valves are sensitive to dirt under certain circumstances, i.e. the function of the valve can be impaired in the case of dirty pressure medium (engine oil of the internal combustion engine). In addition, such control valves are expensive to manufacture because of the small tolerances necessary.

ADVANTAGES OF THE INVENTION

The hydraulic setting device according to the invention and with the characterizing features of the main claim has, in contrast, the advantage that it operates with low losses when no adjusting motion of the differential piston takes place, that it is simple in construction and that the control valve has little sensitivity to dirt.

Further advantages of the invention and advantageous further developments are given in the subclaims and the description.

DRAWING

Two embodiment examples of the invention are explained in more detail in the following description and drawing. The latter shows a simplified representation of a first embodiment example of the hydraulic setting device in FIG. 1. FIG. 2 shows a simplified representation of the pump of the hydraulic setting device and FIG. 3 shows the control valve of the hydraulic setting device in longitudinal section. FIG. 4 shows a simplified representation of a second embodiment example of the hydraulic setting device.

DESCRIPTION OF THE EMBODIMENT EXAMPLES

Figure 1:
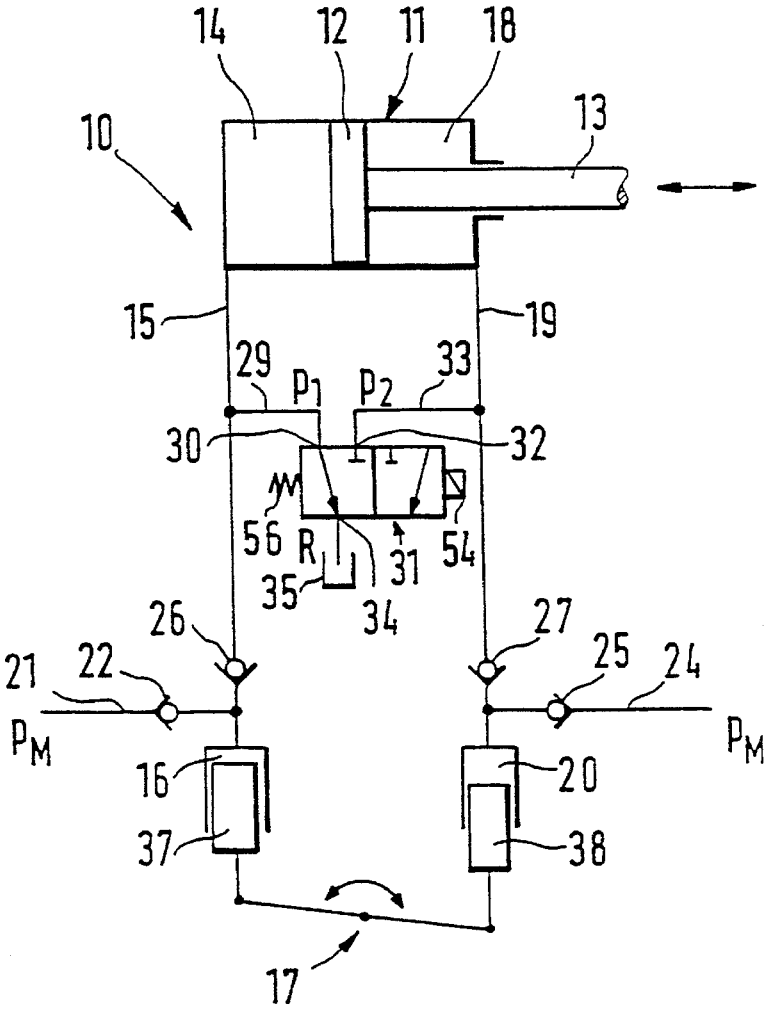

A hydraulic setting device is designated by 10 in FIG. 1 and this device has a differential cylinder 11 with differential pistons 12, 13. The pressure space 14 at the large piston area of the differential piston 12 is connected, via a pressure conduit 15, to a pump working space 16 of a pump 17—shown in more detail in FIG. 2. The pressure space 18 at the smaller effective piston area of the differential piston 12 is connected, via a pressure conduit 19, to a further pump working space 20, acting in opposition to the first pump working space 16, of the pump 17.

The pump working space 16 is supplied with pressure medium via a supply conduit 21 which opens into the pressure conduit 15. A non-return valve 22, which opens when pressure medium flows from the pressure medium source designated by $P_M$ to the pump working space 16, is inserted in this supply conduit 21. The pump working space 20 is connected, in an analogous manner, to the pressure medium source $P_M$ by means of a supply conduit 24, with non-return valve 25, opening into the pressure medium conduit 19. The pressure medium source $P_M$ may, for example, be a device for the pressure medium supply or lubricant supply of an internal combustion engine.

Non-return valves 26 and 27, which open when pressure medium flows from the pump working space to the pressure space, are respectively arranged in the pressure conduits 15 and 19 between the supply conduit 21 and 24, respectively, and the pressure space 14 and 18, respectively.

Figure 3:
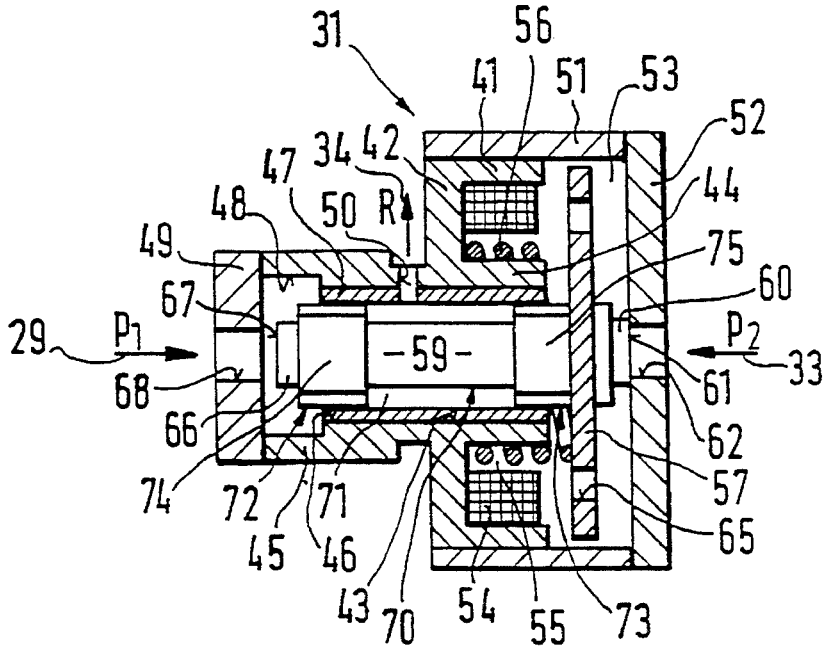

A control conduit 29, which is connected to a connection 30 of a control valve 31— shown in more detail in FIG. 3—branches off from the pressure conduit 15 between the non-return valve 26 and the pressure space 14. In the embodiment example, the control valve 31 is a 3/2-way seat valve and a control conduit 33 which opens into the pressure conduit 19—between non-return valve 27 and pressure space 18—emerges from the second connection 32 of the 3/2-way seat valve. The third connection of the control valve is configured as a return 34 and is connected to a container 35.

Figure 2:
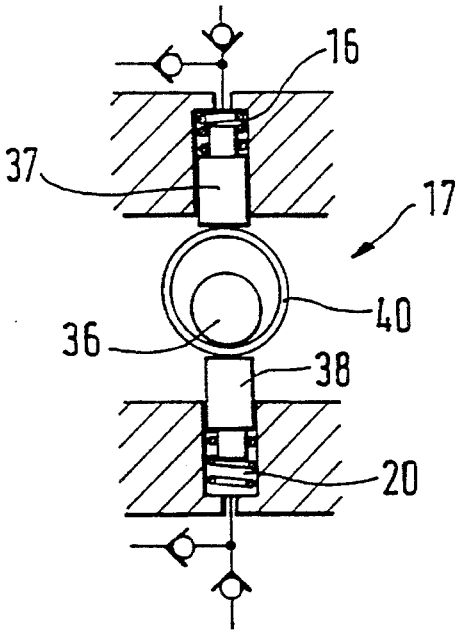

The pump 17, which is diagrammatically represented in FIG. 2, is—in the embodiment example—a radial piston pump with pistons which act in opposition and which are driven by a drive shaft 36 from, for example, the camshaft of an internal combustion engine. When the hydraulic setting device is employed for adjusting the camshaft of a motor vehicle relative to its crankshaft (German Offenlegungsschrift 36 16 234), for example, the camshaft can also be used directly as the drive shaft of the pump. The two pump working spaces 16 and 20 are offset by 180° relative to one another and their pistons 37 and 38 are driven by means of an eccentric 40 arranged on the drive shaft 36.

The control valve 31 shown in FIG. 3 has an approximately cup-shaped housing 41 in the end 42 of which is arranged a central hole 43. Two sleeve-shaped extensions 44, 45 emerge from the end 42 and of these, the extension 44 protrudes inside the housing 41 and the extension 45 points in the opposite direction. The extensions 44, 45 are dimensioned in such a way that their internal spaces, together with the hole, form a cylindrical valve space 46.

A depression 48 extends from the free end surface of the extension 45 and is closed at one end by a cap 49 in contact with the end surface. The depression 48 extends as far as a sleeve 47, which is inserted in the valve space 46 and is manufactured from a non-magnetic material. The sleeve 47 and the extension 45 are penetrated by a transverse hole 50, which is connected to the return 34 of the control valve and connects the valve space 46 to the container 35.

The housing 41 is surrounded by a cylindrical cover 51 in non-magnetic material. This cylindrical cover 51 protrudes beyond the housing towards the top and is closed by a cap 52, thus configuring an armature space 53.

A magnet coil 54, which surrounds the sleeve-shaped extension 44 and whose inner diameter is larger than the outer diameter of the extension 44, is inserted inside the housing 41. A compression spring 56 is inserted in the annular space 55 formed between the magnet coil 54 and the extension 44. One end of this compression spring 56 is in contact with the end 42 of the housing and its other end is in contact with a disc-shaped flat armature 57, which is arranged in the armature space 53.

This flat armature 57 interacts with an essentially cylindrical valve element 59 which is guided in the sleeve 47. The length of the valve element 59 is less than the distance between the caps 49 and 52. The valve element 59 penetrates through the centre of the flat armature 57 and is firmly connected to the latter. On its end surface facing towards the cap 52, the valve element has a step 60 of smaller diameter. The free end surface 61 of the step 60 interacts with a hole 62, configured as a valve seat, in the cap 52 and this hole 62 is connected to the control conduit 33.

Around the valve element 59, the flat armature 57 is penetrated by a plurality of regularly arranged holes 65 used for passing through pressure medium.

The end of the valve element 59 facing towards the cap 49 protrudes into the depression 48, where it has a step 66 of smaller diameter whose end surface 67 interacts with a hole 68, configured as a valve seat, in the cap 49. The hole 68 is used as the first connection 30 of the control valve 31 and is connected to the control conduit 29.

The valve element 59 has a smaller diameter section 70 within the sleeve 47 so that an annular space 71 is configured between the section 70 and the sleeve 47. The larger diameter outer sections 72 and 73 guide the valve element 59 in the sleeve 47 and have flattened regions 74 and 75 used for passing pressure medium and past which pressure medium can flow.

The hydraulic setting device 10 is, for example, employed in a device for the continuous adjustment of the camshaft of an internal combustion engine relative to its crankshaft, a phase shift between these two shafts being generated by this means. A displacement of the differential piston 12, 13 to the left (FIG. 1) generates an adjustment of the camshaft to "retarded" in this device, i.e. to a retarded rotational position and retarded valve actuation. An adjustment of the differential piston to the right consequently generates an adjustment to "advanced" or to advanced rotational position and advanced valve actuation.

In the switching position shown in FIG. 1 of the control valve 31, with no electricity supplied, the control conduit 29 is connected to the container 35, whereas the control conduit 33 is closed at one end by the control valve 31. In this switching position, the step 60, shown in FIG. 3, of the valve element 59 is in contact with the hole 62 connected to the control conduit 33 and closes this hole 62 because of the action of the compression spring 56. At the same time, pressure medium can reach the depression 48 from the control conduit 29 through the hole 68. From the depression 48, there is a connection to the transverse hole 50 and therefore to the container 35, specifically via the space between the sleeve 47 and the flattened regions 74 of the section 72 and via the annular space 71. By this means, the pressure conduit 15—and therefore the pressure space 14 of the differential cylinder 11 also—is relieved to the container 34, whereas the pressure space 18 is subjected to pressure by the pump 17 via the pump working space 20. The differential piston 12, 13 is moved to the left.

If the differential piston 12, 13 is to be moved to the right, the control valve 31 is switched into the second switching position by corresponding activation of the magnet coil 54 so that the step 66 of the valve element 59 closes the hole 68 and, therefore, the control conduit 29 at one end. By this means, the opposite hole 62 is then connected to the transverse hole 50, the return 34 and the container 35 via the armature space 53, the space between the sleeve 47 and the flats 75 of the section 73 and via the annular space 71. In this switching position, the pressure conduit 19, and therefore the pressure space 18, is relieved to the container 35, whereas the pressure space 14 is subjected to pressure by the pump 17 via the pump working space 16 and the pressure conduit 15.

A stationary position of the differential piston 12, 13 is achieved by appropriately pulsed or proportional activation of the control valve 31, a pressure being set in the control conduit 29, and therefore in the pressure space 14, which is just sufficient to balance the return force (acting from the adjusting device) of the differential piston. The hold pressures in this stationary position of the differential piston are therefore very much less than those necessary for a (rapid) adjusting motion.

Corresponding activation of the magnet coil like-wise ensures that, even in the case of changing rotational speeds of the camshaft, these hold pressures are kept at a level which is just sufficient to accommodate the return forces from the device for adjusting the camshaft.

The embodiment, as described, of the hydraulic setting device and of the control valve 31 ensures emergency running of the internal combustion engine even should the control valve or the hydraulic supply fail. In the non-activated condition, the control valve 31 takes up the switching position shown in FIG. 1 because of the action of the spring 56. As previously described, the pressure space 18 is as a result subjected to pressure, whereas the pressure space 14 is relieved to the container 35. In consequence, the differential piston is adjusted to the left ("retarded"). If the hydraulic supply should fail, the differential piston 12, 13 is moved to the left because of the mechanical return force from the device for adjusting the camshaft. In both cases, engine emergency running is ensured because of this resetting to the retarded rotational position of the camshaft.

Because of the embodiment, as described, of the control valve 31 and of the valve element 59, only the pressure of the return 34 is present in the region of the guidance of the valve element. Because of this, the effective guide length for the valve element can, on the one hand, be kept small because no sealing function against higher pressures is necessary. On the other hand, no large pressure difference, by means of which dirt could be delivered into the guide gaps, appears in the guide region of the valve element. In order to avoid metallic debris being deposited in the region of the valve element due to the effect of magnetic fields, the sleeve used for guidance is manufactured from non-metallic material. As shown in FIG. 3, the control valve 31 can be embodied with a flat armature or, also, as a proportional magnetic valve with a correspondingly configured magnetic circuit.

In order to keep the adjustment rate of the differential piston constant over the whole of the rotational speed range of the internal combustion engine and of the drive shaft 36, the control valve 31 can be used as a pressure control valve. Corresponding metering of the magnet force (corresponding activation of the magnet coil) permits the valve element to be pressed onto the valve seat with only the force necessary for appropriate pressure generation. It is then advantageous here to configure the control valve with a correspondingly configured magnetic circuit as a proportional magnetic valve because the adjusting forces differ as a function of the rotational speed of the drive shaft. In order to keep the differential piston 12, 13 in the stationary position, the magnet coil 54 is then activated just sufficiently for the pressure in the control conduit 29, and therefore in the pressure space 14, to be in equilibrium with the return forces acting on the differential piston.

In an advantageous embodiment of the first embodiment example of the hydraulic setting device, the pump 17 is throttled on the suction side, for example by means of slot-controlled suction throttling. This makes it possible to achieve a curve of delivery quantity which is constant over the complete rotational speed range of the internal combustion engine and of the drive shaft. The pump and the suction throttling are laid out in such a way that the beginning of the constant delivery range (constant delivery medium flow) coincides with the lower limiting rotational speed of the working range (for example idling rotational speed of the internal combustion engine). The delivery rate of the pump is matched to the necessary adjustment rate of the differential cylinder. The control valve 31 is in this case designed as a simple magnetic valve with flat armature because no pressure control function—such as that previously described—is necessary. The adjustment rate of the differential piston can be influenced, independently of this, by pulsing the magnetic valve. The hold function (stationary position of the-differential cylinder) can also be achieved by corresponding pulsed activation of the control valve. In order to avoid differential filling of the pump working spaces due to fluctuations in the pressure medium supply in the constant delivery range of the pump, the supply of pressure medium to the pump preferably takes place from a reservoir (container).

Figure 4:
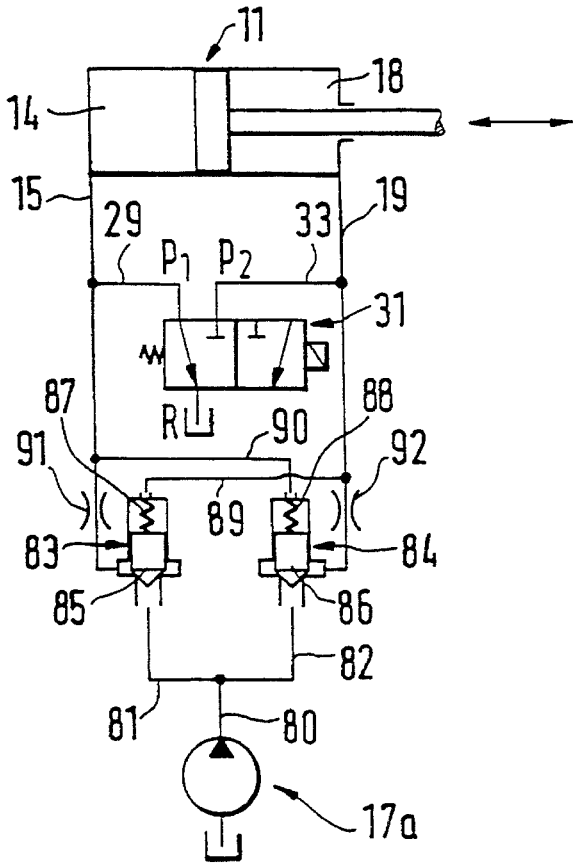

In the second embodiment example of the hydraulic setting device shown in FIG. 4, a pump 17*a* delivers into a common delivery conduit 80 from which two pressure conduits 81, 82 emerge. A pressure-controlled non-return valve 83, 84 is connected to each of the two pressure conduits 81, 82 for switching over the pump delivery flow. The non-return valve 83 is connected at the outlet end to the pressure conduit 15 and the non-return valve 84 is connected to the pressure conduit 19. The non-return valves 83, 84 are configured in such a way that they open in the case of a pressure medium flow from the pump 16a to the differential cylinder 11. For this purpose, the respective valve elements 85, 86 are acted upon by one compression spring 87 or 88 each and additionally by the pressure in a control conduit 89 or 90. The control conduit 89 on the non-return valve 83 is connected at the other end to the pressure conduit 19, whereas the control conduit 90 on the non-return valve 84 leads to the pressure conduit 15.

A throttle 91 is inserted in the pressure conduit 15 between the control conduit 90 and the non-return valve 83. A throttle 92 is likewise inserted in the pressure conduit 19 and, specifically, between the non-return valve 84 and the control conduit 89.

The control valve 31 is connected to the pressure conduits 15 and 19 by means of the control conduits 29 and 33, respectively and, specifically, between the respective control conduits 90 and 89 leading to the non-return valves and the differential cylinder 11.

In the position shown of the control valve 31 and the non-return valves 83, 84, both non-return valves 83, 84 can open in the case of initially unpressurized setting device and when the pump 17*a* is starting. A certain pressure, which is also present in the pressure conduit 19 behind the throttle 92, builds up before the throttles 91 and 92 in the pressure conduits 81, 82 and in the pressure conduits 15 and 19. No such pressure can build up behind the throttle 91 because the pressure conduit 15 is relieved to the container via the control valve 31.

The pressure present in the pressure conduit 19 also acts via the control conduit 89 on the non-return valve 83 so that, because of the additionally acting force of the compression spring 87, the non-return valve 83 is closed. The differential piston is moved to the left ("retarded") by the pressure building up in the pressure space 18 and because of the relief of the pressure chamber 14 to the container 35.

In order to generate an adjustment of the differential piston to the right ("advanced"), the control valve 31 is moved into the second switching position by appropriate excitation of the magnet coil so that the pressure conduit 19 is relieved to the container. Corresponding to the previously described switching position, the non-return valve 84 is then moved into the closed position so that a movement of the differential piston to the right takes place when the pressure space 18 is relieved and the pressure space 14 is subjected to pressure.

The hold position (stationary position of the differential piston) can be achieved either by appropriately pulsed activation of the control valve or by means of a pressure control with a partially excited magnet coil. In order to limit the lost power of the hydraulic setting device, the pressure drop at the throttles 91 and 92 should be limited to between 5 and 10 bar, for example.

We claim:

1. A hydraulic setting device, comprising a hydraulic pump; a differential cylinder having a differential piston subdividing said cylinder into two pressure spaces; an electromagnetically actuated control valve arranged so that in each of said pressure spaces in said differential cylinder a part pressure is set by a partial spilling of pressure medium via said electromagnetically actuated control valve which part pressure can be varied as a function of certain criteria by corresponding activation of said control valve while hold pressures which are very much smaller than adjustment pressures are set in the case of a stationary position of said differential piston; and two conduit devices including a first conduit device emerging from said hydraulic pump and opening into a first pressure space of said pressure spaces and a second conduit device emerging from said hydraulic pump and opening into a second pressure space of said pressure spaces, said electromagnetically actuated control valve being connected between said two conduit devices, said control valve in a stationary position of said differential piston being pulse controlled so that a respective one of said pressure spaces acting against a return force of the hydraulic setting device at said differential piston is filled with such a pressure that a pressure force built in said one pressure space at said differential piston is equal to a return force acting on said differential piston.

2. A hydraulic setting device as defined in claim 1, wherein said control valve is 3/2-way valve of seat type.

3. A hydraulic setting device as defined in claim 1, wherein said control valve has a valve element and a guide; and further comprising a return, said control valve being connected to said return, and a pressure present in said return being effective in a region of said guide of said valve element.

4. A hydraulic setting device, comprising a hydraulic pump; a differential cylinder having a differential piston subdividing said cylinder into two pressure spaces; an electromagnetically actuated control valve arranged so that in each of said pressure spaces in said differential cylinder a part pressure is set by a partial spilling of pressure medium via said electromagnetically actuated control valve which part pressure can be varied as a function of certain criteria by corresponding activation of said control valve while hold pressures which are very much smaller than adjustment pressures are set in the case of a stationary position of said differential piston; and two conduit devices including a first conduit device emerging from said hydraulic pump and opening into a first pressure space of said pressure spaces and a second conduit device emerging from said hydraulic pump and opening into a second pressure space of said pressure spaces, said electromagnetically actuated control valve being connected between said two conduit devices; and a shut-off valve arranged in each of said pressure conduit devices, said shut-off valve in one of said pressure conduit devices being controlled by a pressure in the other of said pressure conduit devices.

5. A hydraulic setting device as defined in claim 4, wherein said shut-off valve is a non-return valve having a valve element; and further comprising a compression spring and a control conduit arranged so that said valve element is acted upon by said compression spring and by a pressure in said control conduit.

6. A hydraulic setting device, comprising a hydraulic pump; a differential cylinder having a differential piston subdividing said cylinder into two pressure spaces; an electromagnetically actuated control valve arranged so that in each of said pressure spaces in said differential cylinder a part pressure is set by a partial spilling of pressure medium via said electromagnetically actuated control valve which part pressure can be varied as a function of certain criteria by corresponding activation of said control valve while hold pressures which are very much smaller than adjustment pressures are set in the case of a stationary position of said differential piston; and two conduit devices including a first conduit device emerging from said hydraulic pump and opening into a first pressure space of said pressure spaces and a second conduit device emerging from said hydraulic pump and opening into a second pressure space of said pressure spaces, said electromagnetically actuated control valve being connected between said two conduit devices; and a shut-off valve arranged in each of said pressure conduit devices, said shut-off valve in one of said pressure conduit devices being controlled by a pressure in the other of said pressure conduit devices; and a throttle arranged in each of said pressure conduit devices.

7. A hydraulic setting device as defined in claim 6, wherein said each of said pressure conduit devices has a non-return valve and a control conduit, said throttle in one of said pressure conduit devices being arranged between said non-return valve and said control conduit controlling said non-return valve in the other of said pressure conduit devices.

* * * * *